US007693289B2

(12) United States Patent
Stathem et al.

(10) Patent No.: US 7,693,289 B2
(45) Date of Patent: Apr. 6, 2010

(54) METHOD AND APPARATUS FOR REMOTE CONTROL OF AN AUDIO SOURCE SUCH AS A WIRELESS MICROPHONE SYSTEM

(75) Inventors: Kelly Stathem, Cleveland Heights, OH (US); Fumio Kamimura, Tokyo (JP)

(73) Assignee: Audio-Technica U.S., Inc., Stow, OH (US)

( * ) Notice: Subject to any disclaimer, the term of this patent is extended or adjusted under 35 U.S.C. 154(b) by 1076 days.

(21) Appl. No.: 10/675,859

(22) Filed: Sep. 30, 2003

(65) Prior Publication Data

US 2004/0106398 A1 Jun. 3, 2004

Related U.S. Application Data

(60) Provisional application No. 60/415,717, filed on Oct. 3, 2002.

(51) Int. Cl.
*H04R 5/00* (2006.01)

(52) U.S. Cl. ..... 381/58; 381/2; 700/94

(58) Field of Classification Search ..... 381/56–58, 381/77, 79, 2–7, 105, 107; 455/419–420, 455/556.1, 3.06; 348/14.05; 700/94; 84/610
See application file for complete search history.

(56) References Cited

U.S. PATENT DOCUMENTS 4,197,498 A * 4/1980 Fukui et al. ..... 455/77
5,832,390 A 11/1998 Irvin
5,872,814 A * 2/1999 McMeekin ..... 375/296
6,021,119 A * 2/2000 Derks et al. ..... 370/261
6,025,553 A * 2/2000 Lee ..... 84/610
6,288,641 B1 * 9/2001 Casais ..... 340/539.26
6,337,913 B1 * 1/2002 Chang ..... 381/14

(Continued)

FOREIGN PATENT DOCUMENTS

JP 4-135398 8/1992

(Continued)

OTHER PUBLICATIONS

Australian Patent Office Search Report related to application No. SG 200305906-0.

(Continued)

*Primary Examiner*—Vivian Chin
*Assistant Examiner*—Lun-See Lao
(74) *Attorney, Agent, or Firm*—Husch Blackwell Sanders Welsh & Katz

(57) ABSTRACT

A method and apparatus is provided for remotely controlling a set of functions for a wireless audio system from a remote control. The method includes the steps of generating a digitally modulated pilot tone, and transmitting this pilot tone within a radio communication to a wireless receiver. The digitally modulated pilot tone carries data about a plurality of functions related to an audio source and its associated transmitter. The method further includes a step of receiving the data at a wireless receiver, augmenting it by information related to the wireless receiver, and communicating the resulting data via a communication network to a remote central control. The method further includes monitoring the resulting data at the remote central control, diagnosing detected problems associated with the wireless audio system, and communicating to the wireless audio system appropriate remedial action to alleviate the detected problems.

20 Claims, 6 Drawing Sheets

U.S. PATENT DOCUMENTS

| | | | | |
|---|---|---|---|---|
| 6,400,935 | B1 * | 6/2002 | Williams | 455/260 |
| 6,449,491 | B1 * | 9/2002 | Dailey | 455/518 |
| 6,510,212 | B2 * | 1/2003 | Ito et al. | 379/102.03 |
| 6,785,513 | B1 * | 8/2004 | Sivaprakasam | 455/63.1 |
| 6,879,806 | B2 * | 4/2005 | Shorty | 455/11.1 |
| 6,920,134 | B2 * | 7/2005 | Hameleers et al. | 370/389 |
| 6,954,538 | B2 * | 10/2005 | Shiraishi | 381/105 |
| 7,054,914 | B2 * | 5/2006 | Suzuki et al. | 709/217 |
| 7,349,667 | B2 * | 3/2008 | Magee et al. | 455/63.4 |
| 2002/0042282 | A1 * | 4/2002 | Haupt | 455/509 |
| 2002/0064164 | A1 * | 5/2002 | Barany et al. | 370/401 |
| 2003/0043051 | A1 * | 3/2003 | Shiraishi | 340/825.25 |
| 2003/0190924 | A1 * | 10/2003 | Agashe et al. | 455/522 |

FOREIGN PATENT DOCUMENTS

| | | | |
|---|---|---|---|
| JP | 7-163856 | | 6/1995 |
| JP | 2002-135156 | | 5/2002 |
| JP | 2002/142266 | | 5/2002 |
| WO | WO 99/18761 | A2 | 4/1999 |
| WO | WO 00/70577 | A1 | 11/2000 |
| WO | WO 01/95669 | A2 | 12/2001 |

OTHER PUBLICATIONS

European Patent Office Search Report related to application No. 03090330.6-2415.

* cited by examiner

Fig. 8
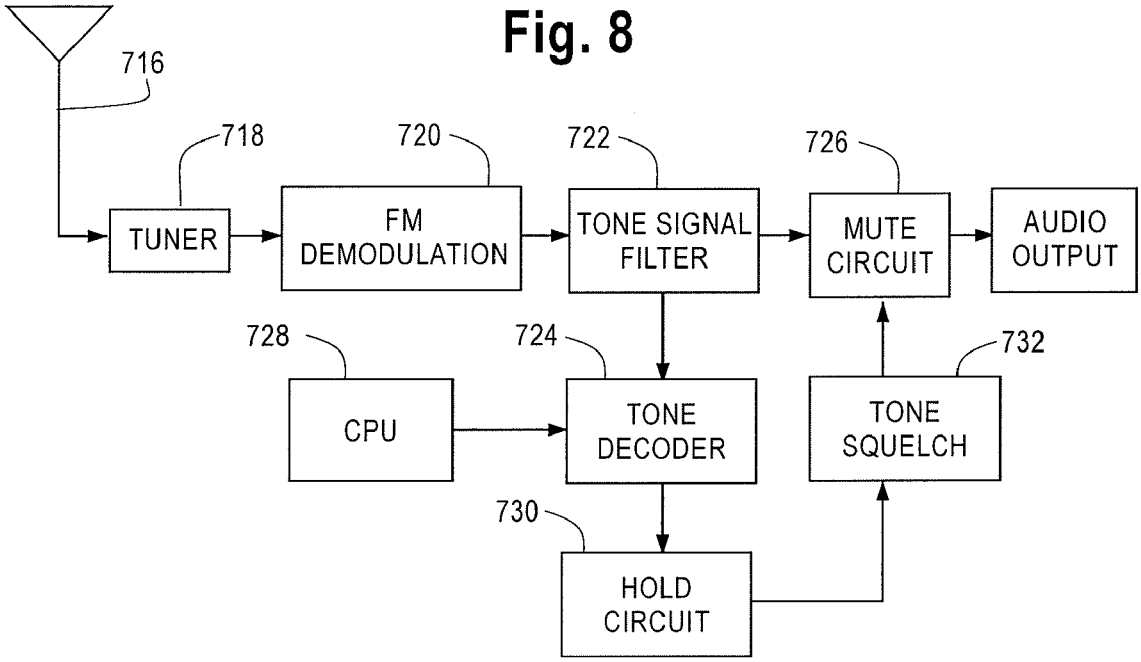
Fig. 9A
| FRAME LEADER (8BIT) | DATA (1) | DATA (2) |
|---|---|---|
Fig. 9B
| 0 | 0 | 0 | 0 | 0 | 0 | 0 | 0 |
|---|---|---|---|---|---|---|---|
Fig. 9C
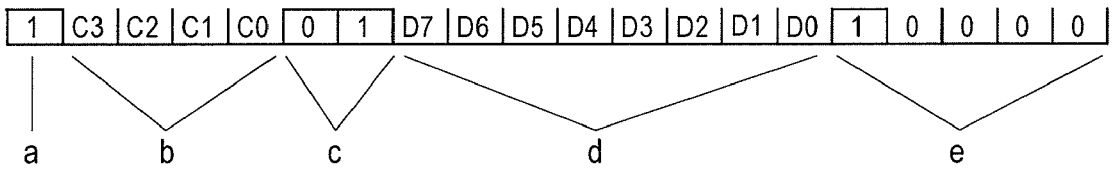
a. START BIT (1BIT)
b. INDEX (4BIT)
c. SEPARATOR (2BIT)
d. DATA (8BIT)
e. STOP SEQUENCE (5BIT)

METHOD AND APPARATUS FOR REMOTE CONTROL OF AN AUDIO SOURCE SUCH AS A WIRELESS MICROPHONE SYSTEM

This application is related to U.S. Provisional Patent Application No. 60/415,717 filed Oct. 3, 2003, now complete. U.S. Provisional Patent Application No. 60/415,717 is incorporated by reference as if set forth in its entirety herein.

FIELD OF THE INVENTION

The present invention generally relates to monitoring of an audio network environment, and, more specifically, to a method and apparatus for monitoring and remotely controlling a wireless audio source via a communication network.

BACKGROUND OF THE INVENTION

Modern audio communication systems, such as microphone systems, provide a reliable infrastructure to transmit voice signals. A wireless microphone system generally comprises an acoustic source such as a microphone and a receiver that are linked to each other via a transmitter. The transmitter therefore facilitates a wireless link between the acoustic energy from the audio source and the receiver.

These audio components, i.e. the microphone, transmitter and receiver, are commonly available in the audio industry. The microphone is an audio transducer in which acoustic energy from a sound source is converted into electric output through an oscillating element that oscillates in response to the transmitted acoustic energy. The electric output is fed to the transmitter.

The transmitter is wireless, and is available either as a handheld device or as a body pack. The transmitter sends the microphone's electric output to the receiver via a signal transmission captured by the receiver's antenna. The signal transmission may be, for example, a Radio Frequency (RF) signal, and a pilot tone is provided to so that the receiver can recognize the signal that is being sent from the transmitter that carries the microphone output.

The receivers can be either a diversity or a non-diversity system. Diversity wireless receiver systems are highly desirable because they effectively combat the most common problem with wireless microphone equipment, namely signal dropouts due to multi-path. Diversity wireless systems also almost always have better operating range than similar non-diversity systems.

Wireless receivers must have either one or two external antennas, and there should be a clear open-air path between these antennas and the transmitter's antenna. Every wireless microphone system operates on a specific frequency. The government dictates which frequency ranges can be used by wireless systems. By government policy, all frequencies are shared by a large number of users across the country. There must be one transmitter and one receiver to make a complete wireless system, and they both must be on the same frequency.

The performance of such wireless microphone systems typically is tested and evaluated at the physical location of their audio components, or at a distant testing and repairing facility. However, both of these situations introduce their respective disadvantages in that they require either a shipment of the wireless microphone components to the distant facility, or require an arrangement for the physical presence of a qualified technical individual at the location where the wireless microphone system is being used.

Recommended Standard (RS) 232 is a commonly utilized standard for serial communications in information handling systems. RS-232 has been around as a standard for decades as an electrical interface between Data Terminal Equipment (DTE) and Data Circuit-Terminating Equipment (DCE). Examples of DTEs include Personal Computers (PCs), workstations, file servers, or print servers that, as a group, are all often referred to as end stations. Examples of DCEs include intermediate network devices that receive and forward data frames across a network that are either (i) standalone devices such as repeaters, network switches, and routers or (ii) communications interface units such as interface cards and modems. RS-232 is used for asynchronous data transfer as well as synchronous links.

The Ethernet has replaced serial ports to dominate the way computers communicate, and has become the communications method of choice. For example, Ethernet Local Area Networks (LANs) consist of network nodes and interconnecting media. The network nodes fall into two major classes: DTEs and DCEs. Typically micro-controller based projects communicate over 10base T Ethernet or higher, and Ethernet boards allow data traffic to and from the Internet. The Internet is only one type of a communication network. Other communication networks may be Local Area Networks (LAN), Wide Area Networks (WAN), Integrated Services Digital Networks (ISDN), wireless networks, and other similar networks to transfer data between two points.

BRIEF DESCRIPTION OF THE DRAWINGS

The benefits and advantages of the present invention will become more readily apparent to those of ordinary skill in the relevant are after reviewing the following detailed description and accompanying drawings, wherein:

FIG. 8 is a schematic diagram of a further embodiment of a wireless receiver system that incorporates a number of aspects of the present invention.

FIGS. 9A-9C are diagrams which illustrate an exemplary frame composition, frame leader format, and data format for 8 bit unit data with asynchronous serial transmission.

DETAILED DESCRIPTION OF THE INVENTION

Figure 1:
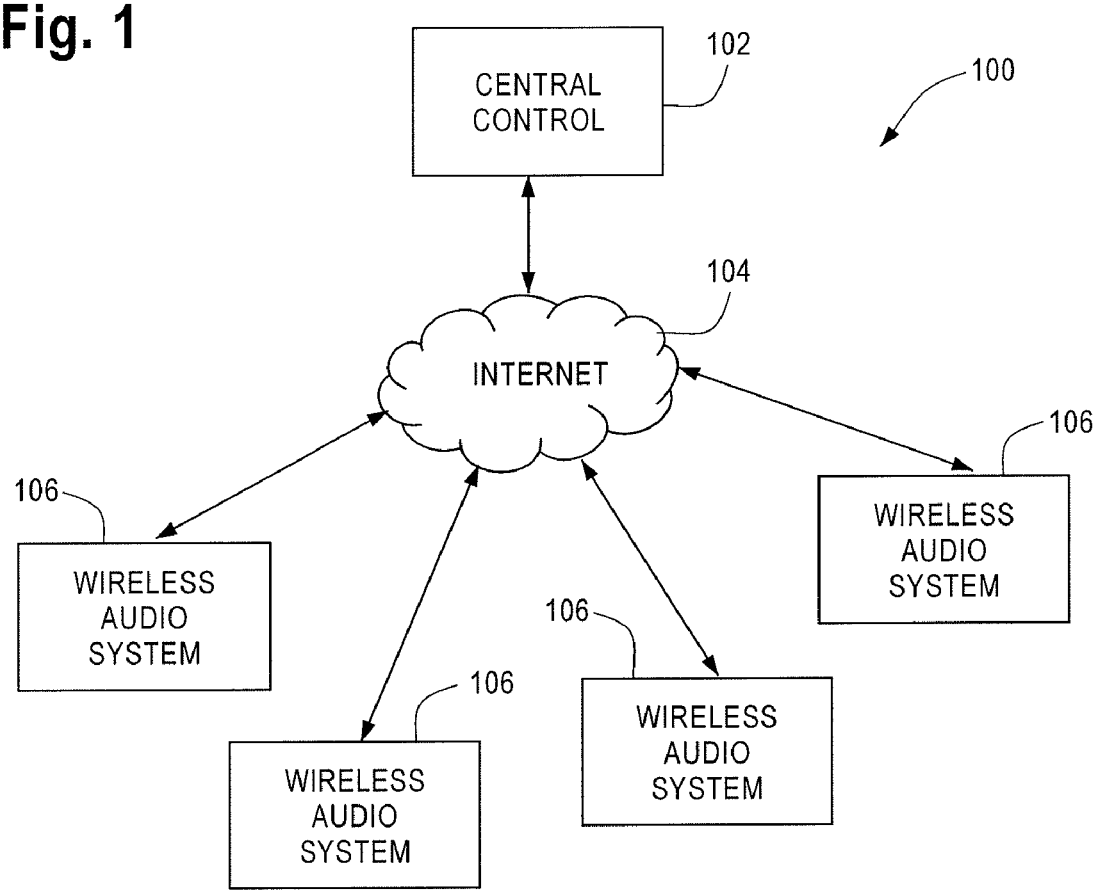
FIG. 1 is a schematic diagram illustrating an exemplary communication network which demonstrates the overall operation of a method of monitoring and controlling a wireless audio source.

While the present invention is susceptible of embodiments in various forms, there is shown in the drawings and will hereinafter be described a presently preferred embodiment with the understanding that the present disclosure is to be considered an exemplification of the invention and is not intended to limit the invention to the specific embodiments illustrated.

It should be further understood that the title of this section of this specification, namely, "Detailed Description of the Invention", relates to a requirement of the United States Patent Office, and does not imply, nor should it be inferred to limit the subject matter disclosed herein.

In the present disclosure, the words "a" or "an" are to be taken to include both the singular and the plural. Conversely, any reference to plural items shall, where appropriate, include the singular.

By using, for example, Ethernet remote control of an audio system such as a wireless microphone, the following functions can be monitored: receiver Internet Protocol (IP) address, receiver link address, receiver RF level, and receiver AF level. In addition, the following functions can also be controlled: receiver name, receiver frequency, receiver squelch level, receiver meter hold (on/off), receiver antenna power (on/off), receiver mute (on/off), default display on receiver state, receiver lock condition, and receiver load/save preset. This is especially advantageous because, for example, problems with audio systems such as wireless microphone systems can be remotely monitored and diagnosed without the need to have the microphone system shipped back to the manufacturer.

In an exemplary embodiment of the present invention, a pilot tone, that is used to allow a wireless receiver to recognize the transmitter signal, is digitally modulated to contain additional information related to the transmitter and the corresponding audio source such as a wireless microphone. This additional information can include, for example, the transmitter name, transmitter type (hand-held or belt-pack), capsule type (condenser or dynamic), input type (microphone or instrument), transmitter gain setting, transmitter power (high or low), battery level, state of transmitter lock mode, state of transmitter mute condition, transmitter preset name. This list can be added to the list of monitored functions, already detailed above.

Important features of the present invention include, for example, the use of robust web-based technologies to monitor and control the plurality of enumerated functions of the wireless audio system in real time. Specifically, the invention enables, for example, remote diagnosis, performance tracking, tuning, and adjustment of the wireless audio system from a remote location. Further, the present invention enables, in an exemplary application, remote troubleshooting and debugging. Indeed, in case a component defect is detected, the remote central control can check whether a remote-fix is possible. If not, the remote central control can alert a local technician to attend to the problem on a real time basis. If the problem is too complicated to be fixed locally, the defective component is removed for repairs at an appropriate technical control.

FIG. 1 is an exemplary communication network 100 illustrating an embodiment of the overall operation that may be used to provide an understanding of the method of monitoring and controlling a wireless audio source. In this exemplary communication network, a remote central control 102 is coupled via the Internet 104 to a number of wireless microphone systems 106. This structure provides for a bi-directional communication between the remote central control 102 and the wireless microphone systems 106. This structure also allows for data that was captured via wireless mode by the wireless systems 106 to be provided to the central control 102 located remotely from the audio source, and the central control 102 can in turn provide to the wireless systems 106 corrective measures for controllable components. This data provided on a continuous real time basis over the Internet 104, could also be sent via a cellular network from the wireless microphone systems 106 to the Internet 104, and from the Internet 104 to the remote central control 102.

Figure 2:
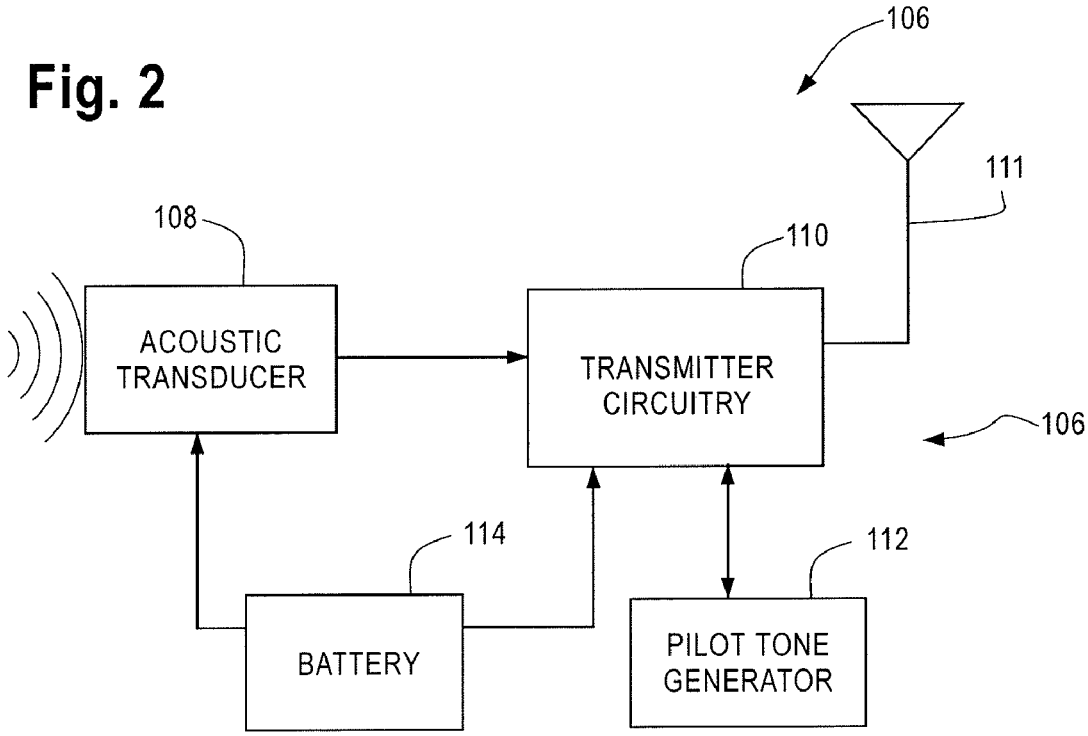
FIG. 2 is a block diagram illustrating an acoustic transducer combined with a transmitter that incorporates a digitally modulated pilot tone generator, utilized in an exemplary embodiment of the present invention.

FIG. 2 is a schematic block diagram of an example of a portion of the wireless audio system 106 shown in FIG. 1. In this exemplary application, wireless audio system 106 comprises a wireless microphone system in which acoustic signals are picked up by an acoustic transducer 108, such as a microphone or a musical instrument. These signals are feed to a transmitter 110. The transmitter 110 converts the audio signals to a radio signal, and broadcasts it via an antenna 111 to a surrounding area. The broadcast is accomplished by using the acoustic signal to modulate a radio carrier and transmit the resulting radio signal effectively. The transmitter 110 is therefore equipped with a circuitry designed to process the audio signal conversion, the modulation and the broadcast of the radio signal. As part of the radio communication, an additional signal, called a pilot tone, is communicated to the wireless receiver. This pilot tone is created by a pilot tone generator 112, and carries typically information related exclusively to the frequency of the radio signal being broadcasted by the transmitter 110. A battery 114 or other suitable power source is included to provide electrical power.

The microphone system 106 includes a power switch, a mute switch, a gain adjustment, and a frequency selector (not shown). Whereas the status of these controls is typically logged locally, in the present invention the pilot tone is digitally modulated and programmed to communicate the status of these controls to a wireless receiver as discussed in greater detail hereinafter. The list of controls that this digitally modulated pilot tone communicates includes further information such as, for example, the transmitter name, the transmitter type, the capsule type, the input type, the level of battery 114 and the transmitter preset name.

Figure 3A:
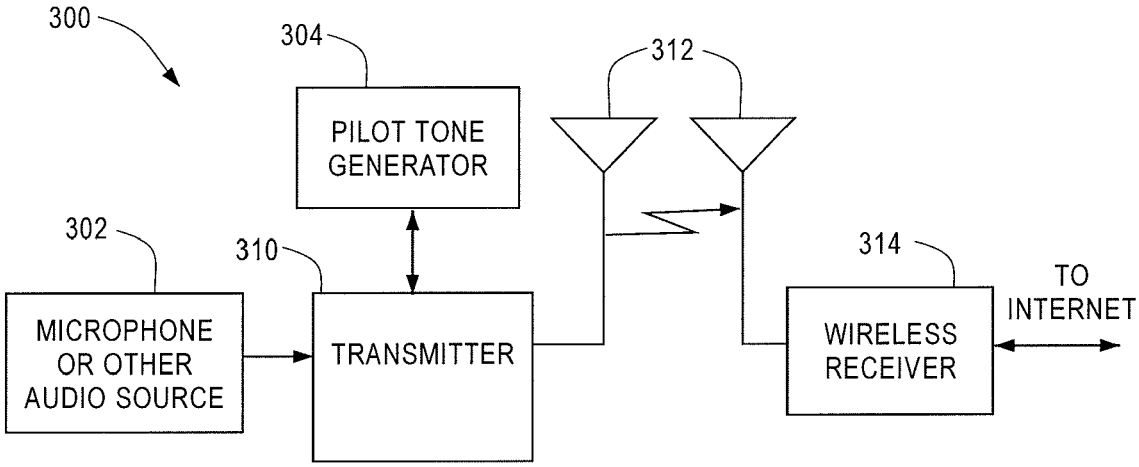
FIGS. 3A and 3B are block diagrams illustrating wireless communication between a transmitter and a receiver which are utilized in an exemplary embodiment of the present invention.
Figure 3B:
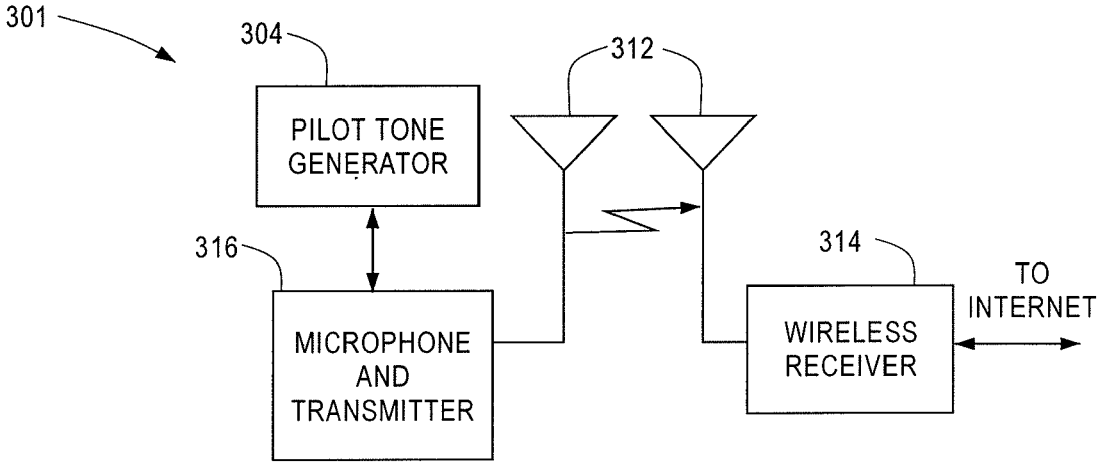

FIGS. 3A and 3B are schematic block diagrams of two wireless microphone systems 300 and 301 that incorporate aspects of the present invention. Systems 300 allow for the sending of information in the form of a radio signal between the transmitters 310 or 316 and the receivers 314. This information is converted to a radio signal, transmitted, received and converted back to its original form. In the present invention, the transmission incorporates the digitally modulated pilot tone, which communicates the additional information, detailed above, about the audio source 302 and the transmitters 310 or 316.

One function of the receivers 314 is to provide a first stage of radio frequency filtering to prevent unwanted radio signals from causing interferences. They should effectively reject signals, which have frequencies substantially above or below the operating frequency broadcasted by the transmitters 310 or 316. The list of controls sent via the digitally modulated pilot tone is logged for monitoring purposes. As indicated earlier, the receivers 314 have a corresponding list of functions that can be controlled remotely. These two lists of functions can be communicated to the central control 102 via the Internet 104. This communication of the functions between the receivers 314 and the Internet 104 is facilitated by the additional components introduced above, i.e. the RS232 and the Ethernet boards.

Figure 4:
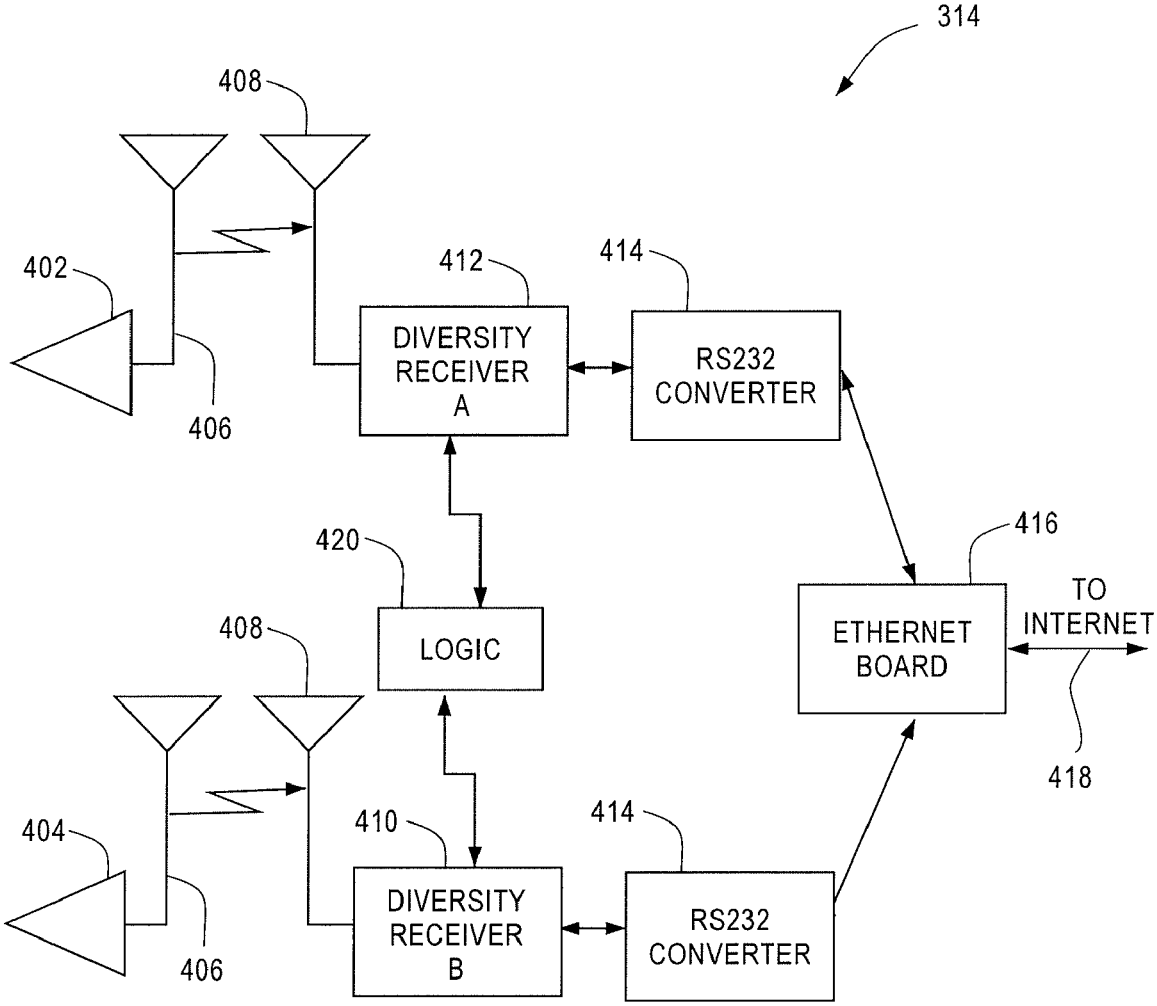
FIG. 4 is a block diagram of an embodiment of a wireless receiver utilized in an exemplary embodiment of the present invention.

FIG. 4 is a block diagram of an embodiment of the wireless receiver 314 shown in FIGS. 3A and 3B. In an exemplary embodiment, receiver 314 comprises an "AEW-5200 Wireless" receiver that is commercially available on the market from Audio Technica USA, Inc. Acoustic signals picked up by microphones or created by musical instruments are transmitted by wireless transmitters, such as the handheld 402 or the body-pack 404, in a wireless mode to diversity receivers 412 and 414.

Wireless transmission signals, typically RF signals, are communicated via antennas 406. These RF transmitted signals are picked up by antennas 408, which are affixed to diversity receivers A and B, 412 and 410. Diversity receivers 412 and 410 are able to avoid signal dropouts due to multipath because they include two antennas and two receiver channels. Special circuits in the receivers select the audio from antennas 408 and receiver channel with the best signal. Because the chances that there will be simultaneous dropouts at both antennas 408 are extremely low, diversity receivers 412 and 410 provide almost complete immunity from dropouts due to multi-path.

Diversity operation can also improve the useful operating range for wireless systems. This is because even when there are no actual total dropouts, multi-path effects can reduce the amount of signal available at long ranges. This can cause the receiver to briefly lose audio well before the transmitter 402 is truly out of range. With diversity, complete signal loss is much less likely and the useful operating range of the wireless system will be extended. In addition a logic device 420 coupled to both diversity receivers A 412 and B 410, can enhance the selection of a received RF signal with the best signal to noise ratio. This selection of the best diversity receiver, A 412 or B 410, is performed continuously and seamlessly for the duration of the audio transmission.

As the transmitted signal is being selected by either diversity receiver A 412, or by diversity receiver B 410 because of its signal strength, sensors monitoring specific functions of the transmitters and the receivers assemble a predefined data list. This predefined data list includes the plurality of functions identified earlier. This data list is communicated to an RS232 converter 414. The RS converters 414 convert the data received from the receivers A 412 and B 410 to the Ethernet board 416. This Ethernet board 416 then facilitates the transmission of the converted data in form of data frames through the Internet 104 to the remote central control 102 (FIG. 1).

Once the data reaches the remote central control 102, it is diagnosed to evaluate the status of the monitored functions. The data acquisition may contain logic that allows a notification, such as an alarm, for any monitored function whenever its corresponding notification characteristics are met. In the case of a controllable function, appropriate controls are communicated back to the wireless control system to adjust or rectify accordingly the controllable function.

In the case of a non-controllable monitored function, the condition of this monitored non-controllable function may be communicated directly to an individual on location for immediate attention, or logged in a for future repair assignments.

The system of the present invention includes the remote central control, the communication network, and can allow for a number of wireless control systems. This system is only limited by the capacity of the remote central control and the communication network to handle data traffic to and from real time simultaneously monitored wireless control systems. The location of these wireless control systems is limited only by their ability to connect to a communication network, such as the Internet.

Figure 5:
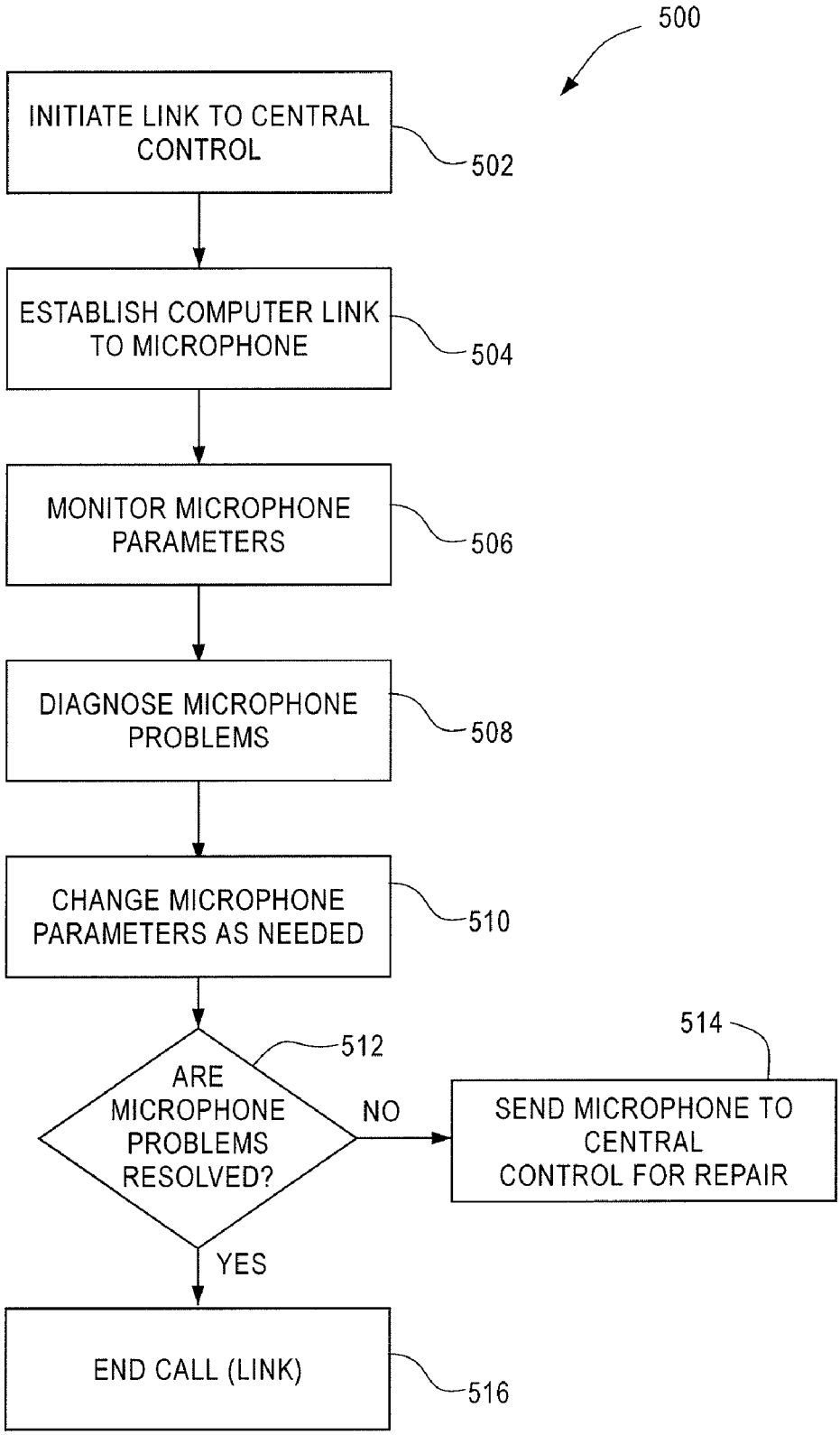
FIG. 5 is a flow chart illustrating an exemplary embodiment of the present invention.

FIG. 5 is a flow chart 500 illustrating an embodiment of the method of monitoring and controlling a wireless audio source such as a wireless microphone. At step 502, a link is initiated to the central control 102. Once the link is made, the wireless microphone system 106 is linked to a computer at the central control 102 at step 504. The central control receives identification information of the wireless microphone system 106 and the corresponding monitored function list. Further operational and instrumentation data is transmitted to the central center for analysis and evaluation of the monitored functions of the wireless microphone system 106 at step 506. Each element of the monitored function list is evaluated against a corresponding stored value or status reference.

In the event a defect or malfunctioning is detected, at step 508, for any element of the monitored functions list, a remedial action will be taken, at step 510, as deemed appropriate based on the recommendation of a technical support based at the central control 102 or an expert system stored in the computer at the central control 102. Such remedial may be changing parameters of the malfunctioning functions of the wireless microphone system 106, at step 510. At step 512, results to the performed remedial actions are evaluated back at the central control 102.

If the defect or malfunctioning is not resolved for any of the controllable monitored functions, the wireless microphone system 106 will be sent for repair to an appropriate repair facility, at step 514. Otherwise, the technical support may choose to suspend the link, at step 516, between the wireless microphone system 106 and the central control 102, or may keep monitoring the wireless microphone system for any part of the audio transmission.

Figure 6:
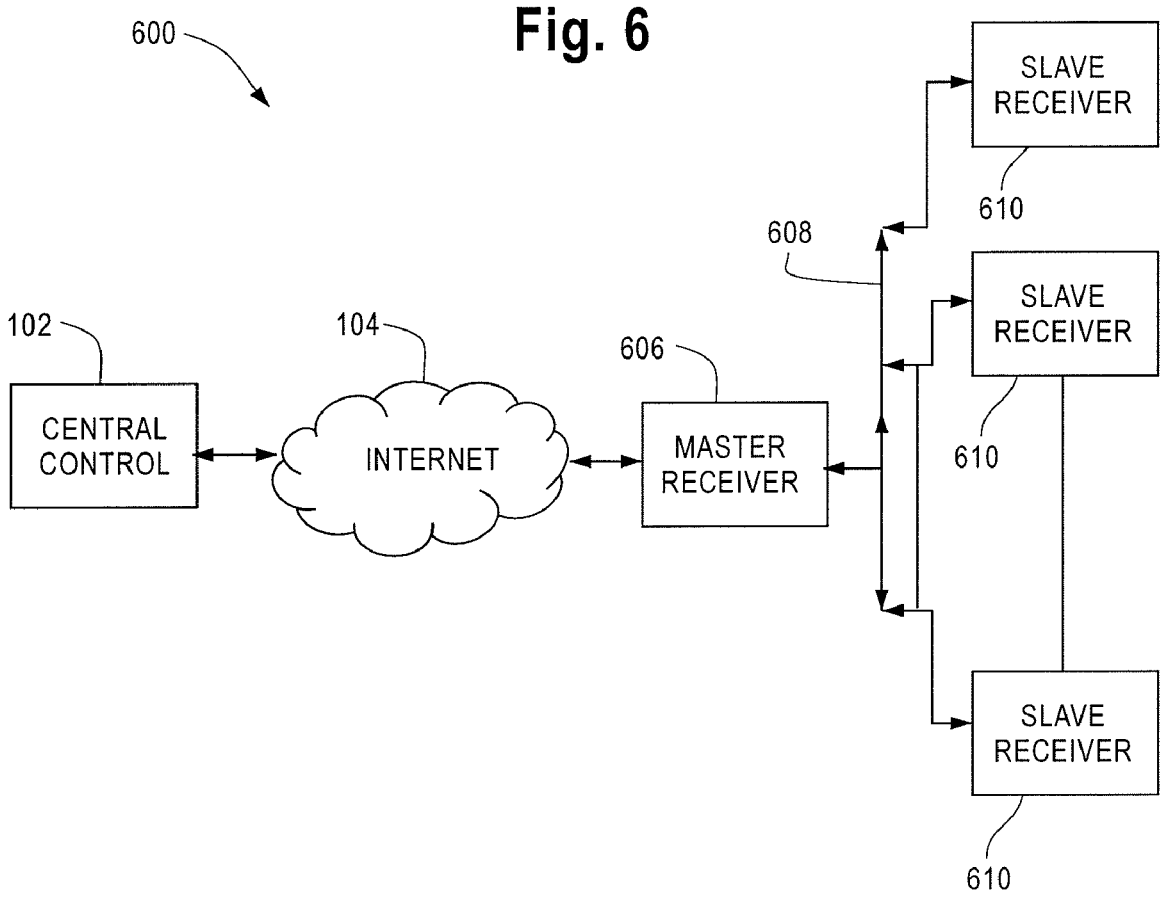
FIG. 6 is a block diagram illustrating a master receiver and a number of slave receivers connected via a communications bus, utilized in a further exemplary embodiment of the present invention.

FIG. 6 is a block diagram illustrating a further exemplary embodiment of the present invention. In this application, a system 600 is shown that comprises a master receiver 606 and a number of slave receivers 610 that are connected via a communication bus 608. In this exemplary communication network, the remote central control 102 is coupled via the Internet 104 to a master receiver 606. The master receiver 606 is, in turn, coupled to a number of slave receivers 610 via, for example, a communication bus 608 or any other communication structure that facilitates a master/slave communication system.

In the master/slave communication system, the master receiver 606 is in total control of communications. This master receiver 606 makes a polling of data (i.e., sends and receives data, such as the plurality of monitored functions introduced above) to each slave receiver 610 in sequence as desired by the central control 102. The slave receiver 610 responds to the master receiver 606 only when it receives a request. This request can be a broadcast to all slave receivers 610, or can be unique to a specific slave receiver 610 as it includes the slave receiver's 610 unique identification in the form of, for example, an Internet Protocol (IP) address. IP addresses are used to deliver packets of data across a communication network and have what is termed end-to-end significance. This means that the source and destination IP address remains constant as the packet traverses the communication network. Each slave receiver 610 will have its own unique IP address to allow correct identification. If a slave receiver 610 does not respond for a predetermined period of time, the master receiver 606 retries to poll it for a number of times before continuing to poll the next slave receiver 610.

As discussed above, each wireless audio system 200 will have a data list that includes the plurality of controllable and non-controllable monitored functions, that corresponds to its wireless communication system. This master/slave system allows the central control 102 to include any desired corrective measures for a specific slave receiver 610, by identifying it in the data packet it communicates to the master receiver 606 by its IP address. The master receiver 606 will, in turn, communicate the desired corrective measures to the targeted slave receiver 610.

Figure 7:
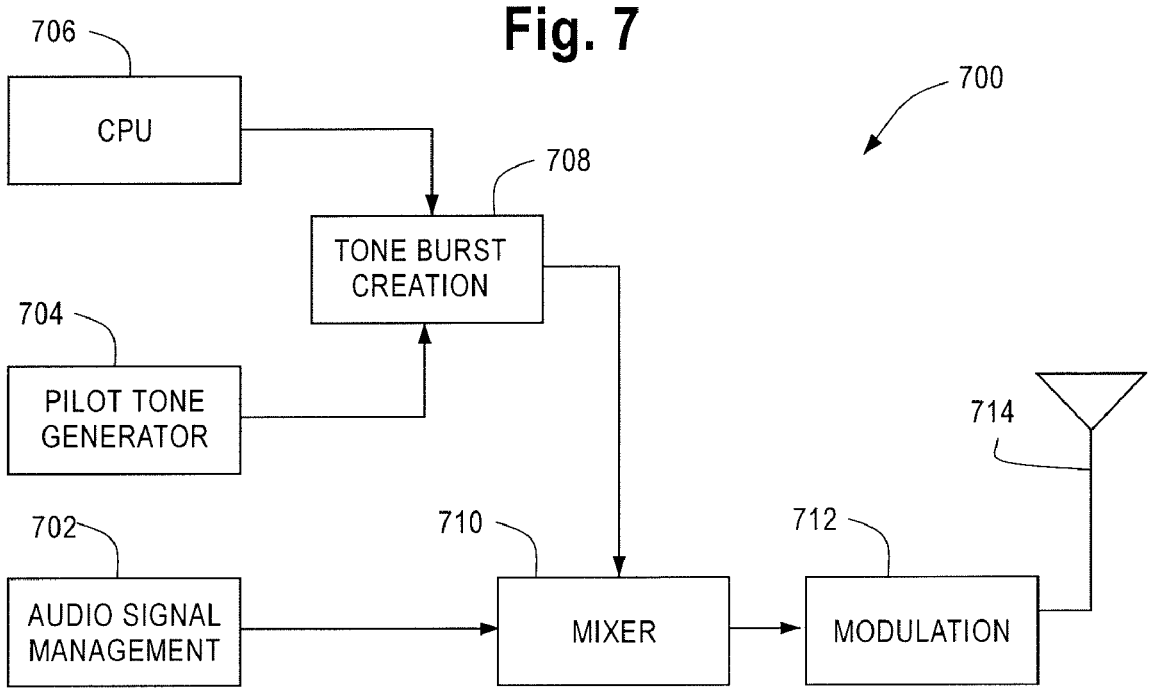
FIG. 7 is a schematic diagram of a further embodiment of a wireless transmitter system that incorporates a number of aspects of the present invention.

Referring to FIG. 7, a specific embodiment of an exemplary transmitter system 700 that incorporates a number of aspects of the present invention is shown. FIG. 8 shows an exemplary receiver system that is used in connection with the transmitter system shown in FIG. 8.

The circuitry shown in FIGS. 7-8 allows transmission of various data between a transmitter and a receiver, and products incorporating such circuitry can be manufactured for minimum cost. For example, there is no additional circuitry required to compensate for the problems associated with recognition of a threshold frequency in the case of amplitude modulation. Similarly, costs associated with the provision of accurate frequency for frequency switching purposes, as well as costs associated with providing multiple oscillators, are eliminated.

On the transmitter side, a function is provided that can intermit the tone signal for accurate frequency by utilization of coded serial number and a tone burst. Serial data is represented by turning the tone signal "on" or "off." As one example, the existence of the tone represents a "1" while no tone represents a "0." This is done at an accurate bit rate (serial data clock).

On the receiver side, the circuitry restores continuous codes with 1 or 0, and the CPU restores them to data. The circuitry also includes a hold circuit that holds the tone burst slightly longer than the maximum period so that a "no tone" occurs at a tone burst. This allows, for example, the receiver to not be muted by mistake even though the tone signal is intermitted. In one exemplary embodiment, the "hold" circuit includes a diode and a capacitor that detects the tone signal, such that the capacitor is big enough to hold the signal through any serial data chatter that may be generated by the mute circuit in connection with the representation of serial data by turning the tone signal on and off.

The receiver circuitry also provides additional advantages. Normally, when a transmitter stops transmitting a wave, the tone for the tone squelch signal is stopped first, and the wave is then stopped after waiting a sufficient time to operate the mute circuit of the receiver. This can introduce unwanted noise into the transmitted signal. To avoid this, a hold circuit is utilized to add additional holding time on the stabilized time for the mute circuit of the receiver. This reduces noise addition to the transmitted signal.

In the exemplary embodiment shown in FIG. 7, all of the illustrated electronics are included in a hand-held wireless microphone or a body pack. Transmitter system 700 includes an audio signal management block 702, which includes an acoustic transducer, and other related circuitry that allows an audio signal to be changed into an electrical signal. A pilot tone generator 704 generates a pilot tone at a frequency, in one exemplary embodiment of about 32 kHz.

A central processing unit (CPU) 706 is incorporated within the transmitter system 700. The CPU 706 provides coded and serialized information from the transmitter to the tone burst creation circuitry 708, which incorporates this information on the tone burst. The resulting signal is fed to a mixer 710 which combines the resulting signal with an audio signal. The combined signal from mixer 710 is modulated at block 712 and the transmitted to ambient atmosphere via high-frequency output antenna 714.

Referring to FIG. 8, a signal from the transmitter system 700 is received by antenna 716 and sent to tuner 718 and demodulator 720 for appropriate tuning and demodulation operations. A filter 722 is included to separate from the transmitted audio signal the tone burst signal. The tone burst signal is fed to a tone decoder 724, while the transmitted audio signal is sent to the mute circuit 726.

The tone decoder receives the tone burst signal from the filter 722, and communicates the decoded result to CPU 728. As discussed in greater detail hereinafter, the decoded result comprises certain serial data. The tone signal is fed from the decoder 724 to a hold circuit 730, and then on to a conventional tone squelch circuit 732. The tone squelch circuit 732 and the mute circuit 726 cooperate to provide an audio output at block 734 that includes substantially reduced noise at minimum cost.

Table 1 set forth below sets forth one exemplary list of the coded serialized data that may be communicated between a transmitter and a receiver of a wireless microphone or other system that incorporates aspects of the present invention:

TABLE 1

| Index Code | Data Name | Format | | Content | |
|---|---|---|---|---|---|
| 0x00 | Audio Amp. Gain | 0001/1111 | | Trim Max | |
| | Condenser Mic.–> | \| | | \| | |
| | | 0000/0000 | | Trim Min | |
| | Dynamic Mic. –> | 1001/1111 | | Trim Max | |
| | | \| | | \| | |
| | | 1000/0000 | | Trim Min | |
| 0x01 | RF Output Level | Bit 0 | 0 | Low | 1 High |
| | Type of Transmitter | Bit 1 | | BP | HH |
| | Condition of Input Selection | Bit 2 | | Guitar | Mic |
| | Situation of limiter usage | Bit 3 | | Off | On |
| | Situation of pre-emphasis usage | Bit 4 | | Off | On |
| | Condition of Mute | Bit 5 | | Norm | Mute |
| | Condition of Key guard usage | Bit 6 | 00 | No Lock | |
| | | | 01 | Power Lock | |
| | | Bit 7 | 10 | Mute Lock | |
| | | | 11 | All Lock | |
| 0x02 | Preset No. | Bit 0 to 3 | | 0 to 15(max) | |
| | Remaining Battery Life | Bit 4 to 7 | | 0x02 to 0x06 | |
| 0x0a | $1^{st}$character of name | | | ASCII Code | |
| 0x0b | $2^{nd}$character of name | | | ASCII Code | |
| 0x0c | $3^{rd}$character of name | | | ASCII Code | |
| 0x0d | $4^{th}$character of name | | | ASCII Code | |
| 0x0e | $5^{th}$character of name | | | ASCII Code | |
| 0x0f | $6^{th}$character of name | | | ASCII Code | |

The data sets encompassed by the present invention, including that presented in Table 1, provides a number of distinct advantages. On the transmitter side, the data sets provide a function that allows a unique wording or code to be associated with that user, and allows the code to be memorized. The gain/output power of an audio amplifier, as well as a setpoint condition of audio mute, can be memorized as well. The data set also allows individual setpoints and user names to be memorized as a set. All of this data, including current information regarding the remainder of battery life, can be coded and transmitted with a tone burst signal as discussed above. On the receiver side, a receiver indicates the setpoint data, and operates by the codes received by the transmitter.

In accordance with this aspect of the invention, it is possible to control a transmitter and a receiver as a set by displaying the user name on the receiver. When the setpoint condition of a transmitter is sent to a receiver with a user name, it is confirmable for a specific setup condition per each transmitter through each receiver. As a result of this, it is not needed for a person using the wireless audio system to make a written note of the user name or setpoint for each transmitter and receiver. This also reduces mistakes and enhances job performance of such personnel.

Referring to FIGS. 9A-9C, diagrams which illustrate an exemplary frame composition, frame leader (header) format, and data format for 8 bit unit data with asynchronous serial transmission are shown. In the illustrated embodiment of the invention shown in FIG. 9A, each frame composition comprises a frame leader including address information (e.g., originating and terminating addresses) and a payload including two duplicates of the data and a trailer that is to be sent from a transmitter to a receiver. FIG. 9B illustrates an eight bit frame leader format. FIG. 9C shows how the data is formatted in an exemplary embodiment of the present invention. It should be appreciated that the embodiments of the invention shown in Table 1 and FIGS. 9A-9C is exemplary in nature, and is not intended to limit the scope of the present invention to the specific embodiments shown. Each system will be specifically tailored to that which is needed by the particular requirements of the user.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method for remotely controlling a set of functions related to a wireless audio system from a remote central control, said method comprising the steps of:

providing an audio system that includes a transmitter and a receiver;

detecting an audio signal via an acoustic transducer located within the transmitter;

modulating a tone burst with a frame of data, including a header with address information, a payload and a trailer, said payload of said frame of data containing a plurality of predetermined, real time status values of monitored functions within said transmitter disposed within respective predetermined locations of the frame;

mixing the modulated tone burst with the detected audio signal;

modulating the mixed audio signal and modulated tone burst;

transmitting the modulated audio signal and tone burst from the transmitter to the receiver and storing the frame of data therein;

establishing a link between the receiver of said wireless audio system and a central control for remotely controlling the set of functions through a communication network;

determining whether or not any problems exist by monitoring said data stored in said receiver from said central control;

communicating from said remote control to said audio system appropriate remedial actions to alleviate any of said problems.

2. The method of claim 1, wherein said audio system comprises a wireless audio system.

3. The method of claim 2, wherein said wireless audio system comprises a wireless microphone system.

4. The method of claim 3, wherein said transmitter comprises a handheld device.

5. The method of claim 3, wherein said transmitter comprises a body pack.

6. The method of claim 1, wherein said receiver comprises a diversity receiver.

7. The method of claim 1, wherein said data comprises data regarding characteristics of said transmitter or said receiver that can be monitored but not controlled.

8. The method of claim 7, wherein said data is selected from a group consisting of: receiver internet protocol address, receiver link address, receiver RF level, receiver AF level.

9. The method of claim 1, wherein said data comprises data regarding characteristics of said transmitter or said receiver that can be monitored and controlled.

10. The method of claim 9, wherein said data is selected from a group consisting of: receiver name, receiver frequency, receiver squelch level, receiver meter hold, receiver antenna power, receiver mute, default display on receiver state, receiver lock condition, receiver load present, and receiver save preset.

11. The method of claim 1, wherein said communicating step includes the step of transmitting replacement data to said receiver that is implemented by said receiver.

12. The method of claim 11, wherein said data is selected from a group consisting of: receiver name, receiver frequency, receiver squelch level, receiver meter hold, receiver antenna power, receiver mute, default display on receiver state, receiver lock condition, receiver load present, and receiver save preset.

13. The method of claim 1, wherein the receiver of said audio system comprises a master receiver and two or more slave receivers that are operatively coupled to said master receiver, each of said slave receivers including a slave transmitter associated therewith.

14. The method of claim 13, wherein said transmitting step comprises the step of transmitting data from the slave transmitter associated with one of said slave receivers to said master receiver, and transmitting said data from said master receiver to said central control.

15. The method of claim 1, wherein said transmitting step comprises the steps of combining data associated with said transmitter with a pilot tone signal, mixing said combined data/pilot tone signal with an audio signal, and transmitting said combined data/pilot tone/audio signal to said receiver.

16. The method of claim 15, wherein said pilot tone signal is at approximately 32 kHz.

17. A wireless microphone system comprising:

a microphone;

a CPU that provides coded and serialized information including a frame of data containing a header with address information, and a payload including a plurality of predetermined, real time status indicators of monitored functions within the wireless microphone, said plurality of status indicators disposed within respective predetermined locations of the payload of the frame;

tone burst creation circuitry that incorporates the provided coded and serialized information into a pilot tone burst;

a mixer that mixes detected audio from the microphone with the pilot tone burst;

a modulator that modulates the mixed audio and pilot tone burst; and a wireless transmitter that wirelessly transmits the modulated audio signal from the microphone mixed with the pilot tone burst.

18. The wireless microphone system as in claim 17 further comprising:

a wireless receiver located in the surrounding area of the wireless microphone that receives the transmitted audio signal and plurality of status indicators from the wireless microphone;

a central control that remotely controls a set of functions of the wireless microphone system; and a communications link established between the wireless receiver and central controller through a public communication network.

19. A wireless microphone system comprising:

a handheld wireless microphone or body pack including an audio management block, a CPU, a mixer, a modulator and an output antenna wherein the audio management block changes an audio signal into an electric signal, the CPU provides coded and serialized information about the handheld wireless microphone or body pack including a data frame, said data frame including a header with address information and a payload, said payload including a plurality of predetermined, real time status values of monitored functions within the handheld wireless microphone, the CPU modules a pilot tone with the coded and serialized information including the data frame where the coded and serialized information occupies respective predetermined locations within the frame, the mixer mixes the changed audio signal and modulated pilot tone and the modulator modulates the mixed changed audio signal and pilot tone burst for wireless transmission through the output antenna.

20. The wireless microphone system as in claim 19 further comprising:

a wireless receiver located in the surrounding area of the handheld wireless microphone or body pack that receives the transmitted audio signal and plurality of status indicators from the wireless microphone;

a central control that remotely controls a set of functions of the wireless microphone system; and a communications link established between the wireless receiver and central controller through a public communication network.

* * * * *